United States Patent [19]

Sakakino et al.

[11] Patent Number: 4,841,109

[45] Date of Patent: Jun. 20, 1989

[54] SLIDE SWITCH

[75] Inventors: Takahiro Sakakino, Nagaokakyo; Koji Ohmori, Takatsuki; Takashi Yoshimura, Mishima; Shoji Kazusaka; Yoshitaka Sunagawa, both of Takatsuki, all of Japan

[73] Assignee: Omron Tateisi Electronics Co., Kyoto, Japan

[21] Appl. No.: 89,814

[22] Filed: Aug. 27, 1987

[30] Foreign Application Priority Data

Aug. 28, 1986 [JP] Japan ..... 61-132233
Dec. 24, 1986 [JP] Japan ..... 61-314084

[51] Int. Cl.[4] ..... H01H 15/02
[52] U.S. Cl. ..... 200/302.1; 200/551
[58] Field of Search ..... 200/302.1, 153 LA, 243, 200/16 A

[56] References Cited

U.S. PATENT DOCUMENTS 4,121,073 10/1978 Bileski et al. ..... 200/243 X
4,324,956 4/1982 Sakakino ..... 200/302.1
4,395,609 7/1983 Sowash ..... 200/153 LA

FOREIGN PATENT DOCUMENTS 3545799 7/1986 Fed. Rep. of Germany ... 200/302.1

*Primary Examiner*—Renee S. Luebke
*Attorney, Agent, or Firm*—Stevens, Davis, Miller & Mosher

[57] ABSTRACT

A slide switch comprising a box-shaped housing base member, a switching contact mechanism housed within the base member, an electrically insulating flexible film member having an external configuration permitting it to be housed within the base member, a striker mounted on the film member, and a cover member mounted on the base member.

10 Claims, 7 Drawing Sheets

SLIDE SWITCH

BACKGROUND OF THE INVENTION

1. Field of the Invention

This invention relates to an electric switch device and, more particularly, to an improved electric slide switch assembly including a sliding operation mechanism.

2. Brief Discussion of the Prior Art

There is a well known electric slide switch in which a box-shaped housing base houses a stationary contact member and a movable contact blade member, the base is covered with an electrically insulating film to seal the base, and a striker is disposed to forcibly contact an external surface of the insulating film, wherein the stationary contact member is electrically switched through the movable contact blade member which is driven in a vertical direction by sliding the striker.

The insulating film, however, is made of a single flat sheet and is subject to deterioration since a supporting periphery thereof is pulled repeatedly by sliding the striker repeatedly. Moreover, when a plurality of switching members are disposed in a side-by-side relationship within a housing base, the sliding striker drives not only its associated movable contact blade but also its neighboring movable contact blade through the film at a neighboring portion thereof bent by the striker, so that neighboring movable contact blades interfere with each other.

OBJECTS AND SUMMARY OF THE INVENTION

It is therefore a primary object of this invention to provide a sealed type electric switch device which includes a slidable knob and performs an improved mechanical operation.

It is a further object of this invention to provide an electric slide switch which has an insulating film to hermetically seal a switching contact mechanism, with an improved mechanical life.

It is another object of this invention to provide an electric slide switch which has an improved construction for an automatic production line assembly.

The present invention provides an electric slide switch comprising a box-shaped housing base member, a switching contact mechanism housed within the base member, an electrically insulating flexible film member having an external configuration to be housed within the base member, a striker mounted on the film member, and a cover member mounted on the base member.

Other objects and advantages of this invention will be apparent to those skilled in the art from the following description of the preferred embodiment in conjunction with the appended drawings.

DETAILED DESCRIPTION

Figure 1:
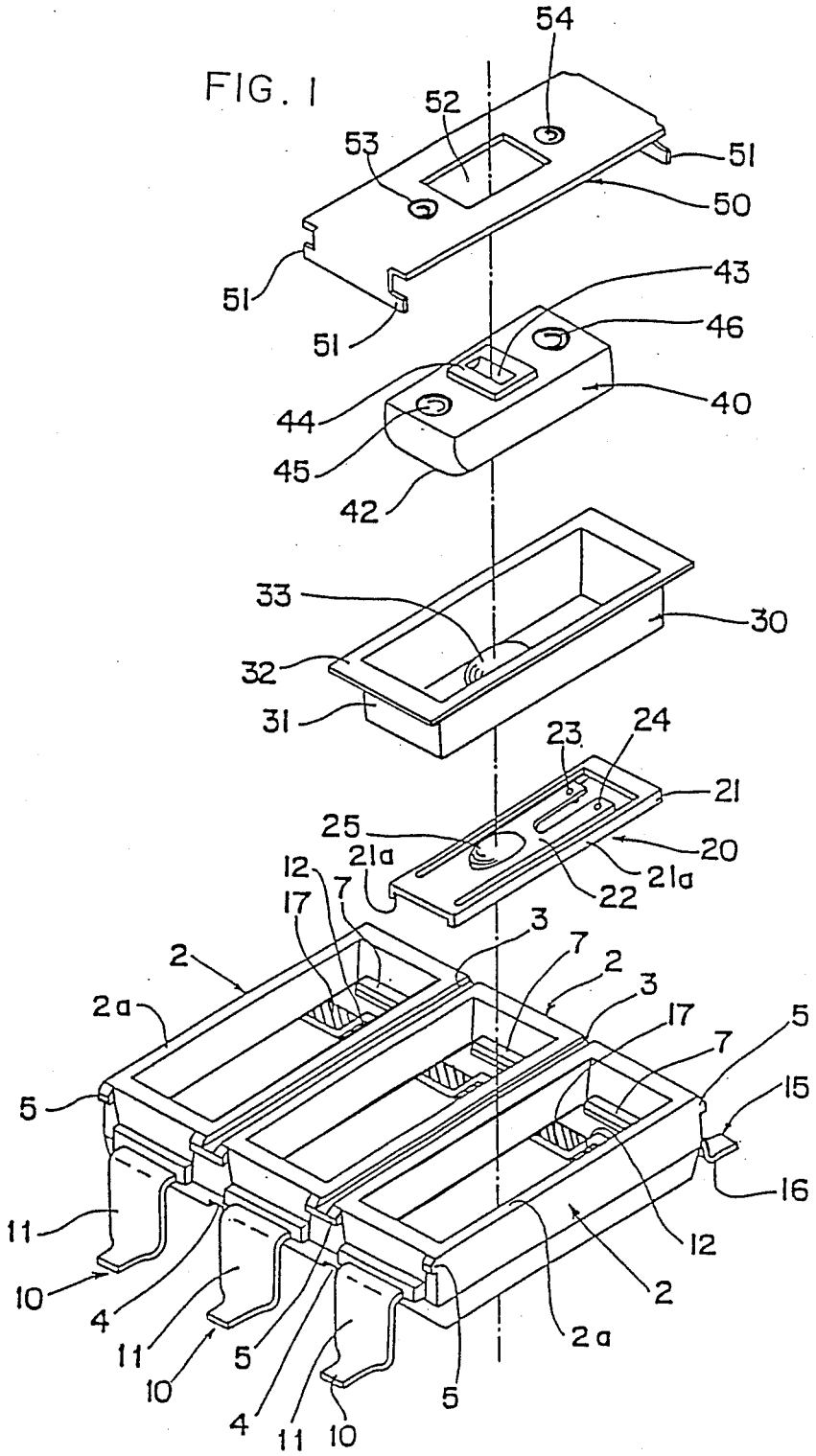
FIG. 1 is a perspective disassembled view of a slide switch as a preferred embodiment of this invention.
Figure 2:
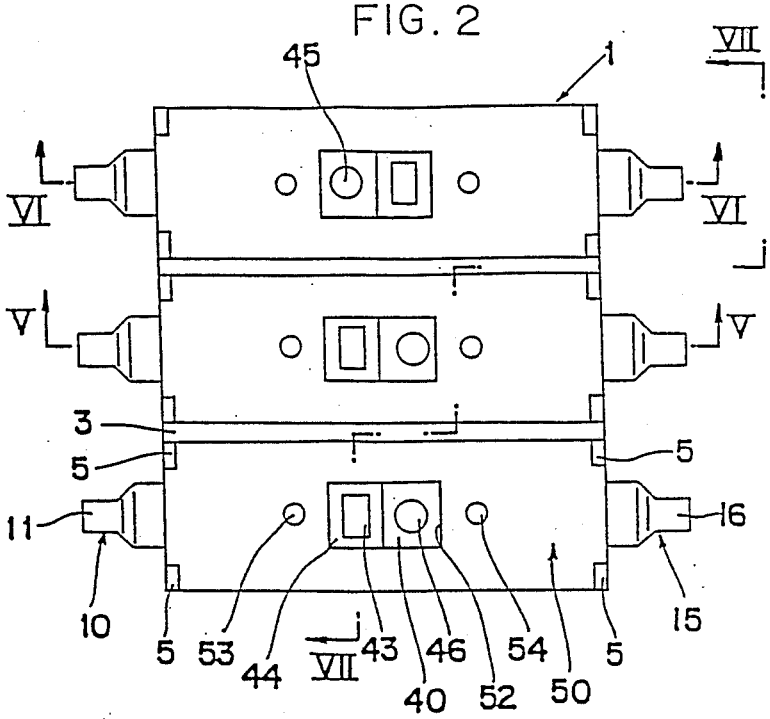
FIG. 2 is a plan view of a base employed in the switch.
Figure 3:
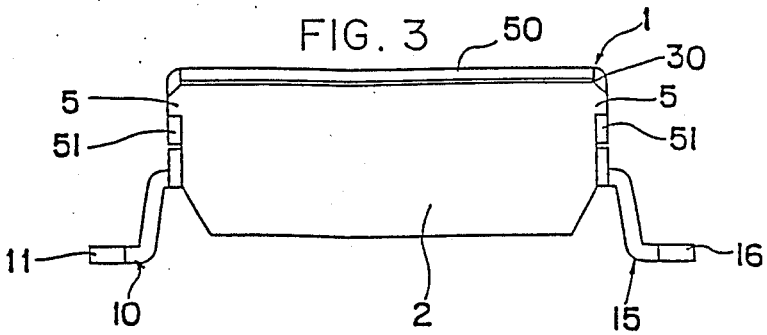
FIG. 3 is a front assembled view of the switch.
Figure 4:
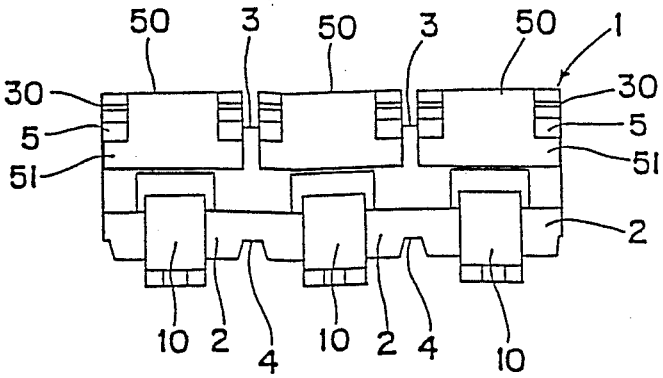
FIG. 4 is a side assembled view of the switch.

As shown in FIGS. 1 through 7, this invention as its preferred embodiment provides a slide switch in which a plurality of elongated box-shaped bases 2 each having a pair of stationary contact terminals 10 and 15 inserted therein are continuously molded as a single unit, and each base 2 houses therewithin a movable contact member 20, an electrically insulating deformed film 30, a slidably movable striker 40 and a cover 50.

The box-shaped bases 2 are made of heat resistant synthetic resin so as to be mountable on printed-circuit boards and the plan scale is designed to be an integer times the pitch of through-holes disposed on the board.

Between neighboring box-shaped base 2 there is provided a pair of opposite grooves 3 and 4 on upper and lower border surfaces thereof for facilitating a cutting separation of the slide switches. On both side walls supporting the terminals 10 and 15 there are disposed a pair of opposite projections 5 to be engaged with a pair of projections 51 of the cover 50. The grooves 3 and 4 are disposed to prevent any deformation in a cut wall when the box-shaped bases 2 are cut by a cutter and to reduce the time for cutting the bases.

The stationary contact terminals 10 and 15 are disposed in a same line, in which the respective terminal portions 11 and 16 outwardly extend from side walls of the base 2 and the respective stationary contact portions 12 and 17 are disposed oppositely in a direction perpendicular to the longitudinal line of the terminal portions 11 and 16. The contact portions 12 and 17 are clad or plated with gold and exposed from a bottom wall of the base 2 so as to make a switching circuit with twin contacts 23 and 24 of the movable contact member 20, as described hereinafter.

The movable contact member 20 includes a rectangular-loop supporting frame 21 and a movable blade 22 supported by the same. The frame 21 is fixed in a position with respect to steps 6 and 7 disposed at the end corners of a bottom wall of the base 2 to support the blade 22, and is reinforced by the opposite side bent portions **21*a* and 21*a*, whereby any external force applied to depress the hereinafter-described striker 40 is so received by the bent portions 21*a* and 21*a* of the frame 21 to prevent any erroneous operation of the switch 1. The movable contact blade 22 includes at free ends thereof a pair of spread twin blades having gold clad or plated movable contacts 23 and 24 downwardly extending therefrom, and at a median portion thereof a projection 25 extending upwardly therefrom to contact an actuating portion 42 of the striker 40**.

The insulating film 30 is formed to have a box shape to be housed within the base 2 by deforming a flat insulating film by a heat press or other deforming method, and a loop flange portion 32 external to a periphery of an opening of the box-shaped film 30. The film 30 further includes on a bottom wall thereof an upward projection 33 to be engaged with the projection 25 on the movable contact blade 22. The insulating film 30 hermetically seals the stationary contact portions 12 and 17 and the movable contact member 20 by a cementing of the flange portion 32 onto a top surface 2*a* of a peripheral wall of the base 2 with a thermosetting cement such as epoxy resin cement or the like to make a single unit.

The striker 40 has an external configuration to be slidably housed within the insulating film 30. It includes at both side lower ends thereof a pair of legs 41 and 41, on one end of a lower surface thereof a downwardly projecting actuating portion 42 to depress the projection 25 on the movable contact blade 22, on upper surface thereof a knob 44 having an actuating area 43, and across the knob 44 a pair of positioning receptors 45 and 46.

The cover 50 is made of a stamped metal plate to cover an upper surface of the base 2, which includes on both ends thereof in a longitudinal direction bent portions having engagement nails 51 to be engaged with projections 5 on the base 2, in a middle portion thereof an actuating window 52 for engagement with the knob 44 of the sriker 40, and across the window 52 a pair of positioning portions 53 and 54 extending downwardly for engagement with the respective receptors 45 and 46 on the striker. If desired, at least one of the portions 53 and 54 of the cover 50 may be disposed upwardly while at least one of the receptors 45 and 46 on the striker 40 also may be disposed upwardly so that they come into engagement with each other.

The operation of this switch 1 will be described hereinafter.

Figure 5:
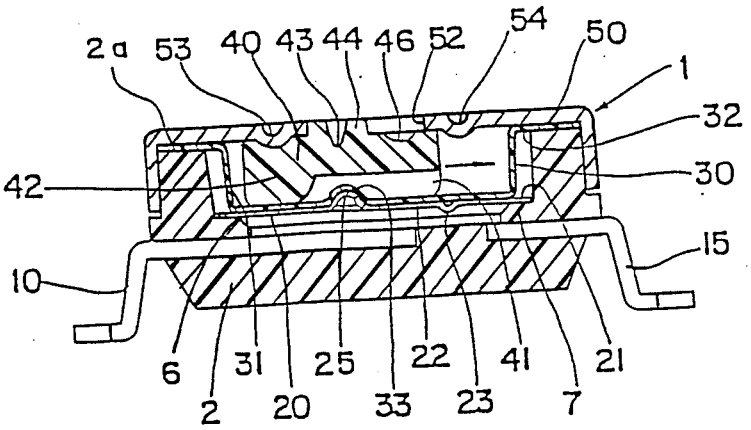
FIG. 5 is a sectional view of the switch taken along the line V—V in FIG. 2.

FIG. 5 illustrates the slide switch in an OFF position where the movable contacts 23 and 24 on the movable contact blade 22 reside in a break position with respect to the stationary contact portions 17 and 12.

Figure 6:
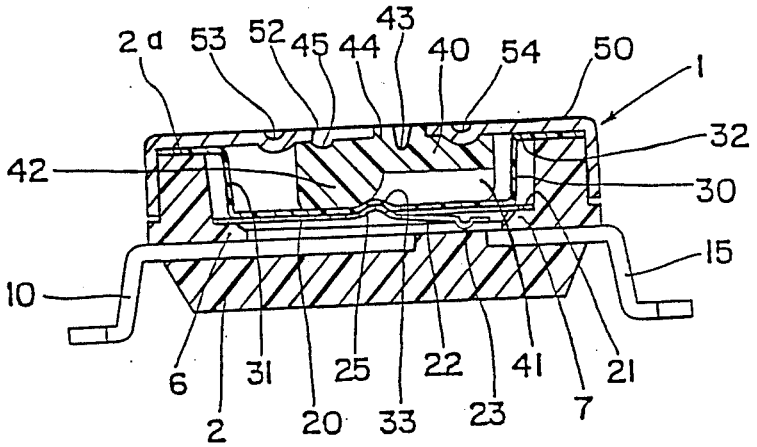
FIG. 6 is a sectional view of the switch taken along the line VI—VI in FIG. 2.
Figure 7:
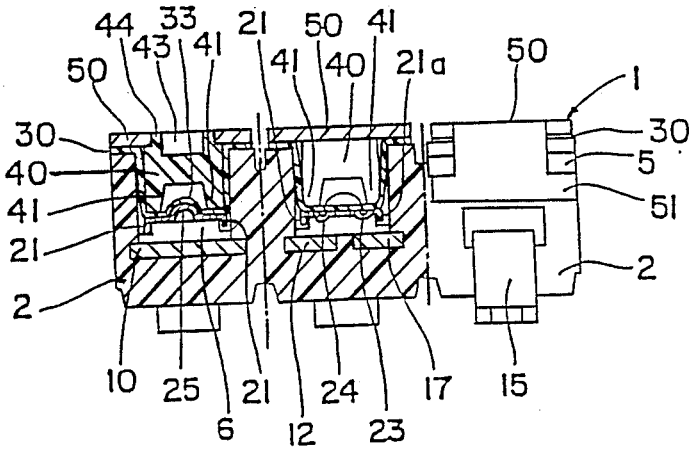
FIG. 7 is a partially sectional view of the switch taken along the line VII—VII in FIG. 2.

As the striker 40 slides in the direction of the arrows, the actuating portion 42 depresses the projection 25 of the movable contact blade 22 through the projecting portion 33 of the insulating film 30 to swing the blade 22, allowing the movable contacts 23 and 24 to move downwardly into contact with the stationary contacts 17 and 12 for making a circuit. Then, the positioning receptor 46 of the striker 40 comes into engagement with the positioning portion 54 of the cover 50 to fix the striker in an ON position ensuring a predetermined contact pressure in the contact portions (FIG. 6). As the striker 40 thereafter slides in an opposite direction, the depression by the actuating member 42 is released so that the movable contacts 23 and 24 move away from the contacts 17 and 12 to their original positions where the receptor 45 comes into engagement with the portion 53 to fix the striker in an OFF position.

The insulating film 30 has a box-shaped configulation, so that the pullng force produced in the film by sliding the sriker 40 is absorbed by deforming its side wall 31 and projecting portion 33, the peripheral supporting portion of the film is free from any deforming stress, and does not interfer with the neighboring movable contact blade. Thus, the mechanical life of the insulating film 30 is prolonged, and sealing the switch is ensured.

The cover 50 and the striker 40 include the respective engaging portions 53, 54, 45 and 46 in this embodiment, but, if desired, these engaging portions may be omitted by utilizing the switching position and operation touch produced by the upward projections 33 and 25.

The film 30 and the cover 50 in this embodiment are provided for each box-shaped base 2, but, if desired, the film and/or the cover may be configured to be a plurality of continuous jointed films and/or covers to reduce the steps for production.

Figure 8:
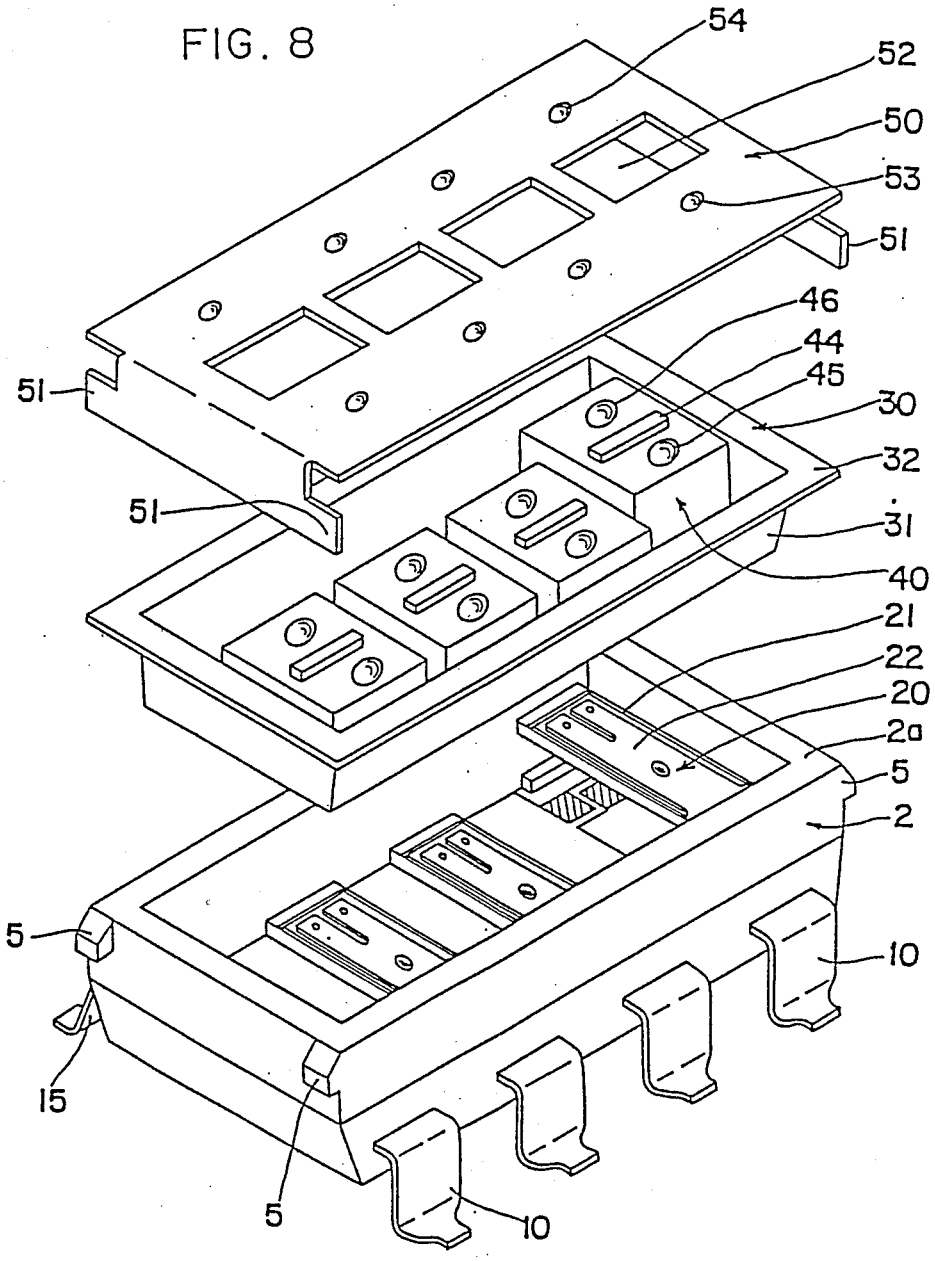
FIG. 8 is a perspective disassembled view of a slide switch as another embodiment of this invention.

In FIG. 8, there is an electrical slide switch modified from the foregoing embodiment in FIG. 1, in which a plurality of contact mechanism units represented by strikers 40 and movable contact members 20 are housed within a single insulating film 30 and covered by a single cover 50. Other components and operation are the same as those in the foregoing embodiment, and their detailed description is omitted for simplification.

Since the film 30 and the cover 50 can be assembled in one step, the number of assembling steps is reduced, so that the production work is improved. The side wall 31 of the insulating film 30 also is adapted to absorb any pulling force by sliding any striker 40 by being deformed, so that the film around any striker 40 is free from being bent and does not interfer with any neighboring movable contact blades.

Figure 9:
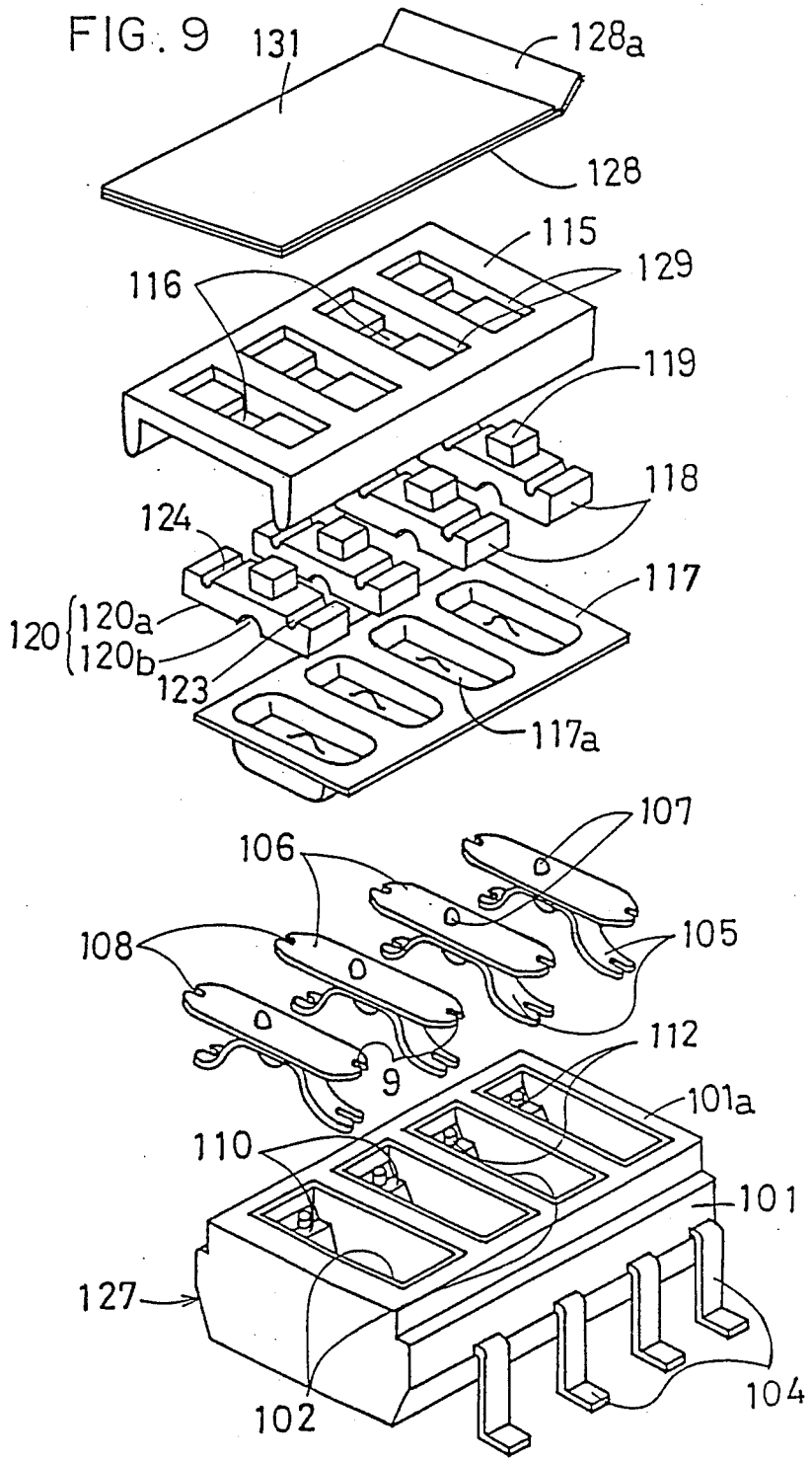
FIG. 9 is a perspective disassembled view of a slide switch as still another embodiment of this invention.
Figure 10:
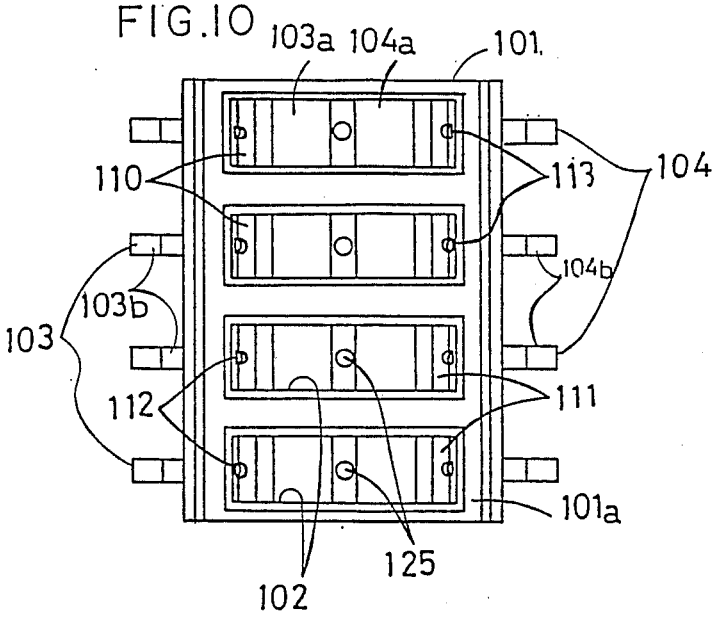
FIG. 10 is a plan view of a base employed in the switch of FIG. 9.
Figure 11:
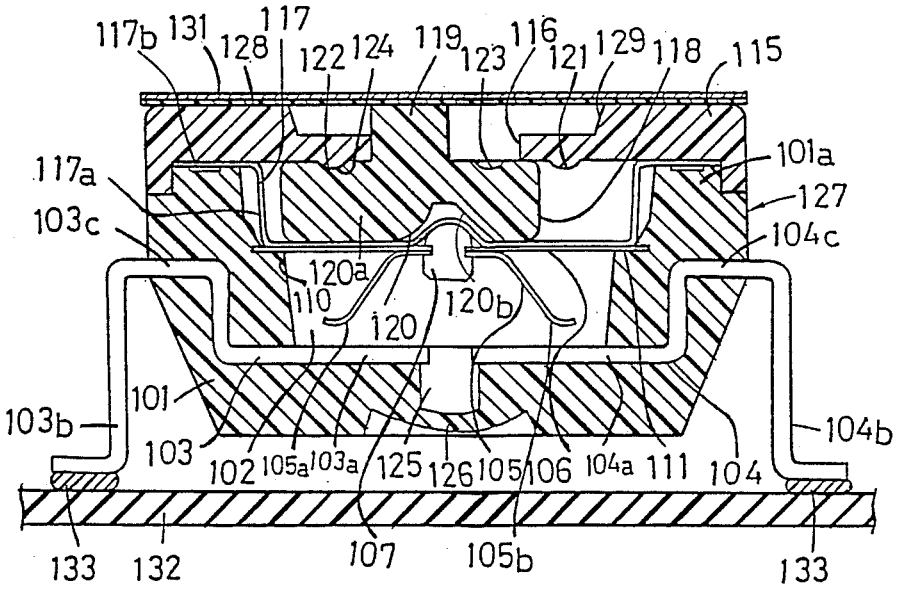
FIG. 11 and 12 are front sectional assembled views of FIG. 9 to illustrate the operation of the switch put on a board.

Returning to FIG. 9, there is shown a disassembled slide switch in yet another embodiment of this invention. The switch includes a housing base 101 made of synthetic resin having a plurality of concave areas 102 each housing a pair of stationary contact terminals 103 and 104 as shown in FIGS. 10 and 11.

A spring plate 106 carries a movable contact blade 105 and is engaged with projections 112 and 113 disposed on steps 110 and 111 within the concave area 102 through cut portions 108 and 109 of the plate 106 to flexibly support the blade 105 for a vertical movement. A cover 115 having a plurality of windows 116 through which knobs 119 of strikers 118 extend is joined together with upper end surface 101*a* of the base 101 through an insulating film 117. The base 101 at its bottom wall includes a vent 125 for exhausting air within the concave area 102 on mounting the sealing film 117. The vent 125 is closed by a closing portion 126 of base 101.

A film 128 is removably mounted on the cover 115 through cement 130 and supports infrared reflection metal foil 131, such as vapored aluminum (A1) film or the like.

The operation of the switch in this embodiment will be described hereinafter.

Figure 12:
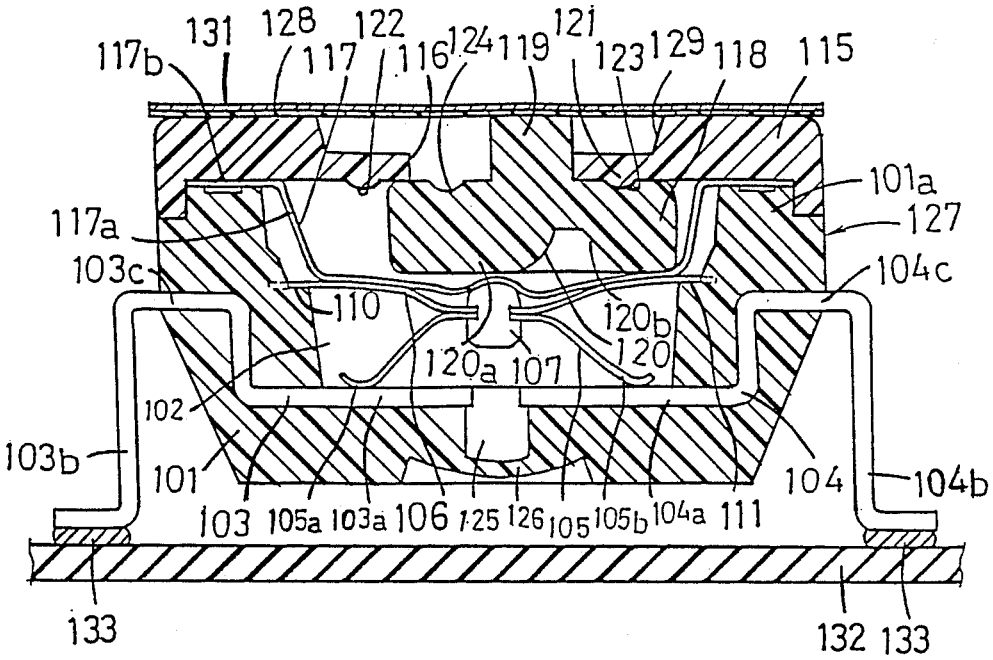
Figure 13:
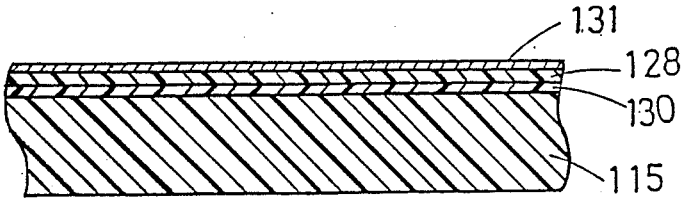
FIG. 13 is a sectional enlarged view of a part of an upper portion of the switch of FIG. 11.

As the knob 119 moves from an OFF position of FIG. 11 to an ON position of FIG. 12, a cam portion 120 of the striker 118 at a projection 20*a* thereof depresses through film 117 a rivet 107 joining the plate 106 and the blade 105, so that the movable blade 105 at both ends 105*a* and 105*b* thereof comes into contact with stationary contact terminals 103 and 104. In the OFF position the movable contact blade 105 is unbiased so it does not contact the terminals, so that its mechanical life is prolonged and electrical insulation between the blade 105 and the stationary contact terminal is ensured.

In the event that the switch is mounted on a printed circuit board (PCB) 132, as shown in FIGS. 11 and 12, soldering cream 133 is sandwiched between a circuit pattern of the PCB and the external ends 103*b* and 104*b* of the terminals 103 and 104 and is hardened by infrared radiation. The infrared radiation is reflected by the A1 film 131, so that the plastic cover 115 and film 128 are free from deforming.

The chuck film 128 covers the windows 116 of the cover 115, so that this switch can be easily transported by sucking the film 128.

The foregoing description should be taken merely as illustrative and not limited into any sense, the invention being defined by the appended claims.

What is claimed is:

1. A slide switch comprising:

a base member forming a housing;

an electrically insulating flexible film member housed within said base member;

a striking member mounted on one side of said film member and supported in said housing for sliding movement; and, a switching contact mechanism housed within said base member on the other side of said film member and capable of being actuated by sliding movement of said striking member, said switch contact mechanism comprising:

a pair of spaced stationary contacts provided at a lower portion of said housing;

a movable contact blade having a mountain shape and a pair of contact portions at opposite ends of said blade for respectively engaging with said pair of spaced stationary contacts;

a spring plate member for supporting said movable contact blade within said housing at a position where said contact portions of said movable blade are both spaced from said pair of stationary contacts, said spring plate having a projection associated therewith for engaging with said striking member, said striking member having a profile which engages with said projection through said film upon sliding movement of said striking member to cause a deflection of said spring plate and the movement of the contact portions of said movable blade into respective engagement with said stationary contacts.

2. A slide switch according to claim 1 in which said film member includes a projection for engaging with said switching contact mechanism.

3. The slide switch as in claim 1 wherein said projection is formed by a member joining said movable contact blade to said spring plate.

4. The slide switch as in claim 1 further comprising a vent provided in said base communicating with an area of said housing containing said switch contact mechanism, said base including means for closing said vent.

5. A slide switch according to claim 1 in which said electrically insulating flexible film member has a box-shaped configuration.

6. A slide switch according to claim 5 in which said flexible film member further includes at its upper periphery a loop shaped flange fitted to an upper opening of said base member.

7. The slide switch as in claim 1 further comprising a cover member mounted on said base member.

8. The slide switch as in claim 7 further comprising a thin film supporting an infrared radiation reflection metal foil, said thin film being removably mounted on said cover member.

9. The slide switch as in claim 7 wherein said cover member contains an aperture to permit access to said striking member.

10. The slide switch as in claim 9 further comprising a thin film supporting an infrared radiation reflection metal foil, said thin film being removably mounted on said cover member.

* * * * *